US006810997B2

(12) United States Patent
Schreiber et al.

(10) Patent No.: US 6,810,997 B2
(45) Date of Patent: Nov. 2, 2004

(54) CONTROLLED DESCENT DEVICE

(75) Inventors: Philip H. Schreiber, Denver, CO (US); Timothy W. Ecker, Thornton, CO (US)

(73) Assignee: Mine Safety Applicances Company, Pittsburgh, PA (US)

( * ) Notice: Subject to any disclaimer, the term of this patent is extended or adjusted under 35 U.S.C. 154(b) by 0 days.

(21) Appl. No.: 09/899,588

(22) Filed: Jul. 5, 2001

(65) Prior Publication Data

US 2002/0179372 A1 Dec. 5, 2002

Related U.S. Application Data

(60) Provisional application No. 60/216,110, filed on Jul. 6, 2000.

(51) Int. Cl.[7] ..... A62B 1/12
(52) U.S. Cl. ..... 182/238; 182/233
(58) Field of Search ..... 182/238, 233, 182/236, 73, 70, 5; 188/266, 65.2–65.4; 254/377, 381–391, 405

(56) References Cited

U.S. PATENT DOCUMENTS

| | | | | |
|---|---|---|---|---|
| 3,188,052 A | | 6/1965 | Longworth | |
| 4,359,139 A | * | 11/1982 | Bloder | 182/238 X |
| 4,372,433 A | | 2/1983 | Mitchell et al. | |
| 4,480,716 A | * | 11/1984 | Soubry et al. | 182/238 X |
| 4,487,292 A | * | 12/1984 | Smith et al. | 182/238 X |
| 4,655,327 A | * | 4/1987 | Tomioka et al. | 182/233 |
| 4,674,599 A | | 6/1987 | Nelson | |
| 4,722,422 A | * | 2/1988 | Hiraoka | 182/238 X |
| 4,877,110 A | * | 10/1989 | Wolner | 182/232 |
| 5,351,906 A | * | 10/1994 | Feathers | 182/237 |

FOREIGN PATENT DOCUMENTS

| | | |
|---|---|---|
| FR | GB 375 210 | 6/1932 |
| FR | 1 270 109 | 8/1961 |
| FR | 1 488 544 | 7/1967 |
| GB | 2256413 | 9/1992 |

* cited by examiner

*Primary Examiner*—Hugh B. Thompson, II
(74) *Attorney, Agent, or Firm*—James G. Uber

(57) ABSTRACT

A controlled descent device for use in industrial or recreational settings for controlled descent of a user from an upper level to a lower level. The device comprises principally a steel housing, an internal spring-loaded drum on which a webbing line is wound, and an attachment to a harness worn by a user. A centrifugal brake mechanism which acts upon the drum to limit the rate of descent includes a manufactured one-way bearing. The line constituent provides increased shock absorbing capabilities and is field replaceable.

19 Claims, 6 Drawing Sheets

CONTROLLED DESCENT DEVICE

This application claims the benefit of Provisional Application No. 60/216,110, filed Jul. 6, 2000.

FIELD OF THE INVENTION

The present invention relates generally to a controlled descent device intended for use in industrial or recreational settings. More particularly, in industrial settings, the present invention is used for emergency rescue or evacuation of personnel from a height by lowering them to safety at a controlled rate. In recreational settings, such as artificial rock climbing walls, it serves as a hands free belay device which lowers a climber to the ground at a controlled rate.

BACKGROUND OF THE INVENTION

Controlled descent devices of various types have been in use in general industry as a component in rescue and evacuation systems on buildings, bridges, towers, derricks, ladders, roofs and tanks and in a variety of settings including manufacturing, construction, oilfield, refinery and maintenance. An example of one such device is currently manufactured by Rose Manufacturing under the product name Dynescape® descender.

As shown in FIGS. 1–3, the Dynescape® descender is a controlled descent device 100 that consists principally of a steel housing 101 with an installation bracket 120, an internal spring-loaded drum 103 on which a wire line 102 is wound, and a snaphook 105 on the line for attachment to a full body harness (not shown) worn by the user. Attached to the housing 101 is a centrifugal brake mechanism 107 which acts upon the drum 103 to limit the rate of descent. The wire line 102 passes around a pulley 123 and through a nozzle 104 before exiting the housing 101.

During forced line extraction, line 102 which is wrapped around the drum 103 produces a moment, causing the drum 103 to rotate on its axle 108. During line retraction, a constant force spring 106 biased in the direction of retraction acts on the drum 103 causing it to rotate in the direction that feeds line onto the drum 103. A bull gear 109 rigidly fixed to the drum 103 rotates with the drum 103. The bull gear 109 is meshed with a pinion gear 110. The axis of rotation of the pinion gear 110 is aligned with the centrifugal brake mechanism 107. The pinion gear 110 is linked to a pinion shaft 111 and is coupled in such a manner that when rotation is in the direction produced during line extraction, the two rotate together. During line retraction, the pinion shaft 111 and pinion gear 110 remain uncoupled, such that the pinion gear 110 spins freely on the pinion shaft 111, and the pinion shaft 111 remains stationary. Through this interaction of the pinion gear 110 and pinion shaft 111, the centrifugal brake mechanism is only engaged to rotate during line extraction.

The pinion shaft 111 is supported by two roller bearings 112, and is rigidly linked to a brake hub 113. Three dowel pin spokes 114 protrude axially from the hub, and engage with three brake shoes 115. The brake shoes 115 are formed of arc shaped steel masses with a brake liner material 121 bonded to their outer surfaces. The end of each spoke 114 is situated within a bore 122 centered in the brake shoes 115. The bore 122 is oversized with respect to the spoke diameter, providing a loose fit that permits both axial and rotational degrees of freedom of the brake shoe 115 within the confines of the brake housing 116. The three brake shoes 115 are contained in a brake housing 116 with a cylindrical interior 117. During braking, this cylindrical surface 117 mates with the curved brake shoe liner material 121. During line extraction, the pinion gear 110, pinion shaft 111, hub 113, spokes 114 and brake shoes 115 all rotate in unison within the housing. As the brake shoes 115 rotate with sufficient angular velocity, they are forced outward, along the axis of the spokes 114, towards the brake housing 116, due to centripetal acceleration. The centripetal acceleration acting on the brake shoe 115 forces the brake shoe 115 against the housing cylindrical surface 117, producing friction that resists line extraction. The friction force is increased by the camming action of the brake shoes 115. Because the bore 122 in the brake shoe is oversized with respect to the spoke 114, the shoe 115 will tilt when in sliding contact with the brake housing 116. This tilting cams the leading end of the shoe braking surface towards the housing 116, increasing the braking friction force.

As mentioned previously, the mechanism linking the pinion shaft 111 to the pinion gear 110 permits relative rotation between these two components in one direction only. The pinion shaft 111 has a rectangular slot (see FIG. 3) cut perpendicular to its axis. This slot contains a double ended sliding key 118. The key interacts with an internal cam profile 119 cut into the shoulder of the pinion gear. The cam profile 119 is a one-way ratchet shape with three high points, three low points, and three steps. This shape produces forced engagement of the sliding key 118 against the ratchet step when rotation of the pinion is in the direction of line extraction. The high point of the profile pushes one end of the sliding key 118, such that the opposite end is forced into the low point and against the ratchet step on the opposite side of the cam profile. During line retraction, a relief angle on the key 118 and cam profile 119 allow the key 118 to flutter back and forth in the slot without engaging against the step of the cam profile 119. The pinion gear 110 is thereby free to rotate about the pinion shaft 111 during line retraction, keeping the brake mechanism uncoupled from the drum 103. During line extraction, the pinion gear 110 remains rotationally fixed to the pinion shaft 111, keeping the brake mechanism engaged to rotate as the drum 103 rotates.

As the Dynescape® descender is intended for emergency use it typically is not subject to prolonged use. During prolonged use, components of the Dynescape® descender may need to be replaced due to increased wear. The sliding key 118 may become worn by the cam profile during prolonged use. The sliding key 118 may also become bent or deformed when subject to impact loading. Impact loading can occur in recreational applications when a climber attempts to jump for a hold that is out of reach, and free-falls on the line. Such prolonged use or abuse will eventually lead to compromised performance of the braking mechanism, which may engage during both line retraction and extraction.

A need exists, therefore, for a more robust design that will withstand repeated use and impact loading and whose components are not susceptible to wear during prolonged use.

Another feature of the Dynescape® device is that the line 102 is a wire rope. Over prolonged use this wire rope line 102 is prone to bird-caging (unraveling or kinking). Bird-caging is felt to be a result of the line material and the manner in which the line is layered onto the drum. Because the line is not stacked in consecutive layers and can cross itself, it can bind with itself and rub against itself as it is reeled on and off the drum during line retraction and extraction. Additionally, because the wire line 102 is a stiff member it is not capable of absorbing considerable energy in the event that a user free-falls on a slack line.

Another need exists, therefore, to develop a line that is not prone to bird-caging and which is capable of serving as a shock absorber during a user fall. An additional need exists for a field-replaceable line which allows a worn or deteriorated line to be replaced by a new line without having to return the device to the factory.

SUMMARY OF THE INVENTION

The present invention comprises a controlled descent device for use in industrial or recreational settings for lowering a user to the ground at a controlled rate.

Like the Dynescape® descender device, the controlled descent device of the present invention includes a steel housing containing a line wound on a spring loaded drum. The line feeds out of the housing through a nozzle. A snap hook or carabiner on the free end of the line is used to attach to a full-body harness worn by the user. A constant force retraction spring acts on the drum to retract the line into the housing as the user ascends or when the line is released. A centrifugal brake mechanism engages the drum to produce a resisting force when the line is extracted. This brake mechanism slows a user's descent rate by paying out extracted line at a controlled rate.

The braking mechanism of the present invention is similar in function to that of the Dynescape® device, however, the pinion, pinion shaft, and brake hub have each been modified. The pinion gear, slider key, and pinion shaft have been replaced by a single pinion gear with shaft. The brake hub is no longer rigidly linked to the shaft. Instead the hub is supported on the shaft by a one-way roller bearing. The one-way roller bearing connecting the shaft to the hub permits engagement of the brake mechanism only during cable extraction. During retraction, the pinion with shaft will rotate freely, while the hub, spokes and brake shoes remain stationary. The pinion with shaft and one way roller bearing are not as susceptible to wear during prolonged use.

The line of the present invention is preferably constructed from a flat webbed material such as nylon which is wrapped onto the drum in consecutive layers. Other suitable materials include polyester or any webbing with similar elastic properties having a minimum 20% elongation at break. The use of webbing in this configuration has several advantages over wire line. Because nylon webbing or the like will stretch under load, the webbing serves as a shock absorber in the event that a climber free-falls on a slack line. The manner in which the webbing is wrapped onto the drum in consecutive layers also serves as a shock absorbing mechanism. During free-fall arrest, tension on the line pulls the wraps of the webbing tighter around the drum. Friction between consecutive layers of webbing absorbs the energy of a fall. In this manner, the webbing on the drum acts as an efficient shock absorber when the line is fully paid out or when the line is fully retracted. When fully paid out, the stretch of the extracted line under load absorbs the energy of a fall. When fully retracted, the wraps of webbing about the drum absorbs the energy of a fall.

Because the webbed line of the present invention is susceptible to abrasion and wear, the present invention may preferably incorporate a linkage that allows a worn or deteriorated line to be detached, and a new line be reattached in the field by the user. This avoids having to return the device to the factory to have the line replaced.

Thus, it may be seen that an improved controlled descent device is provided whose braking components are less prone to wear, and whose line provides increased shock absorbing capabilities and is field replaceable.

BRIEF DESCRIPTION OF THE DRAWING

An illustrative and presently preferred embodiment of the invention is shown in the accompanying drawings in which.

DETAILED DESCRIPTION OF THE INVENTION

Figure 1:
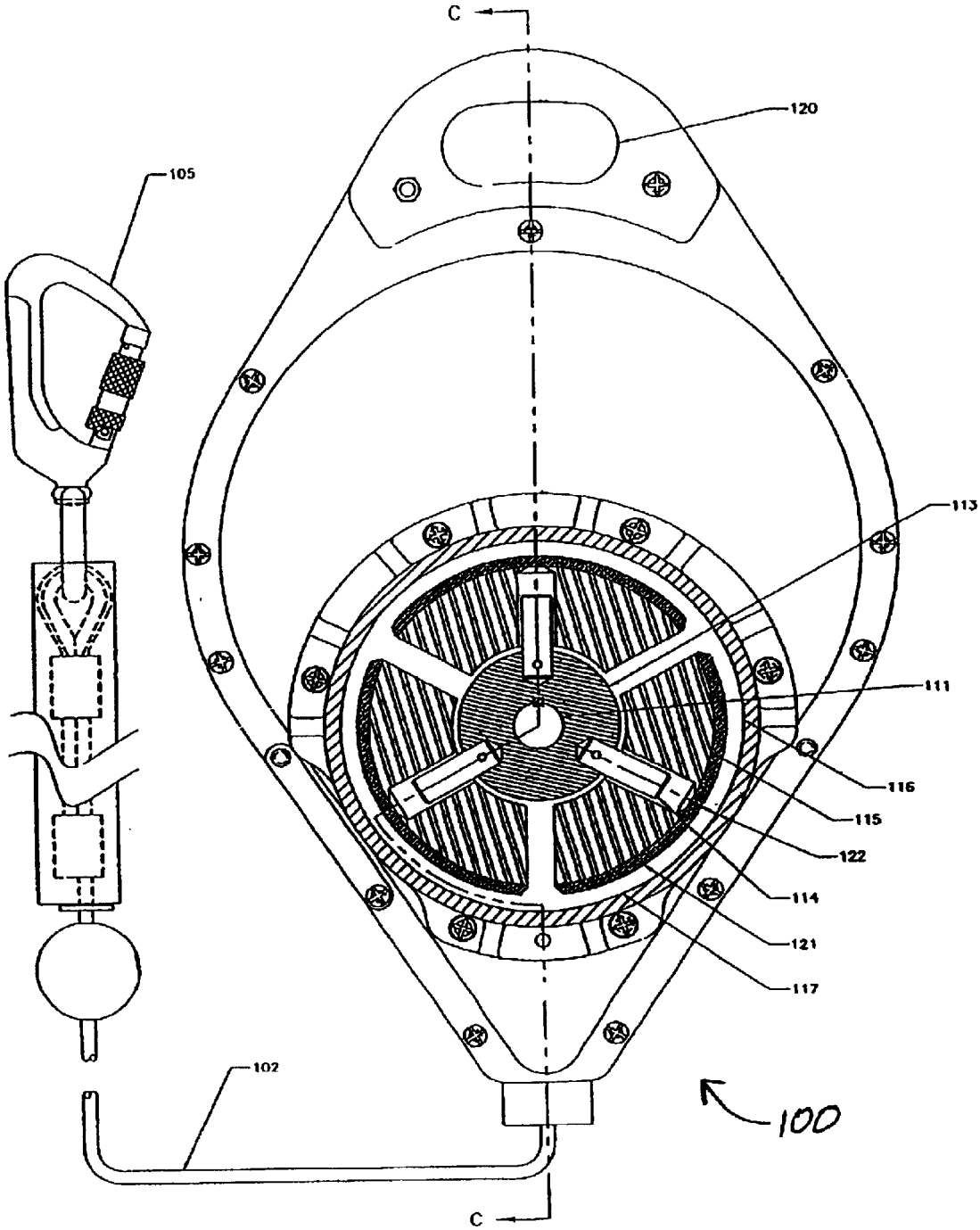
FIG. 1 PRIOR ART
FIG. 1 is front view, partially in section of the prior art Dynescape® descender.
Figure 2:
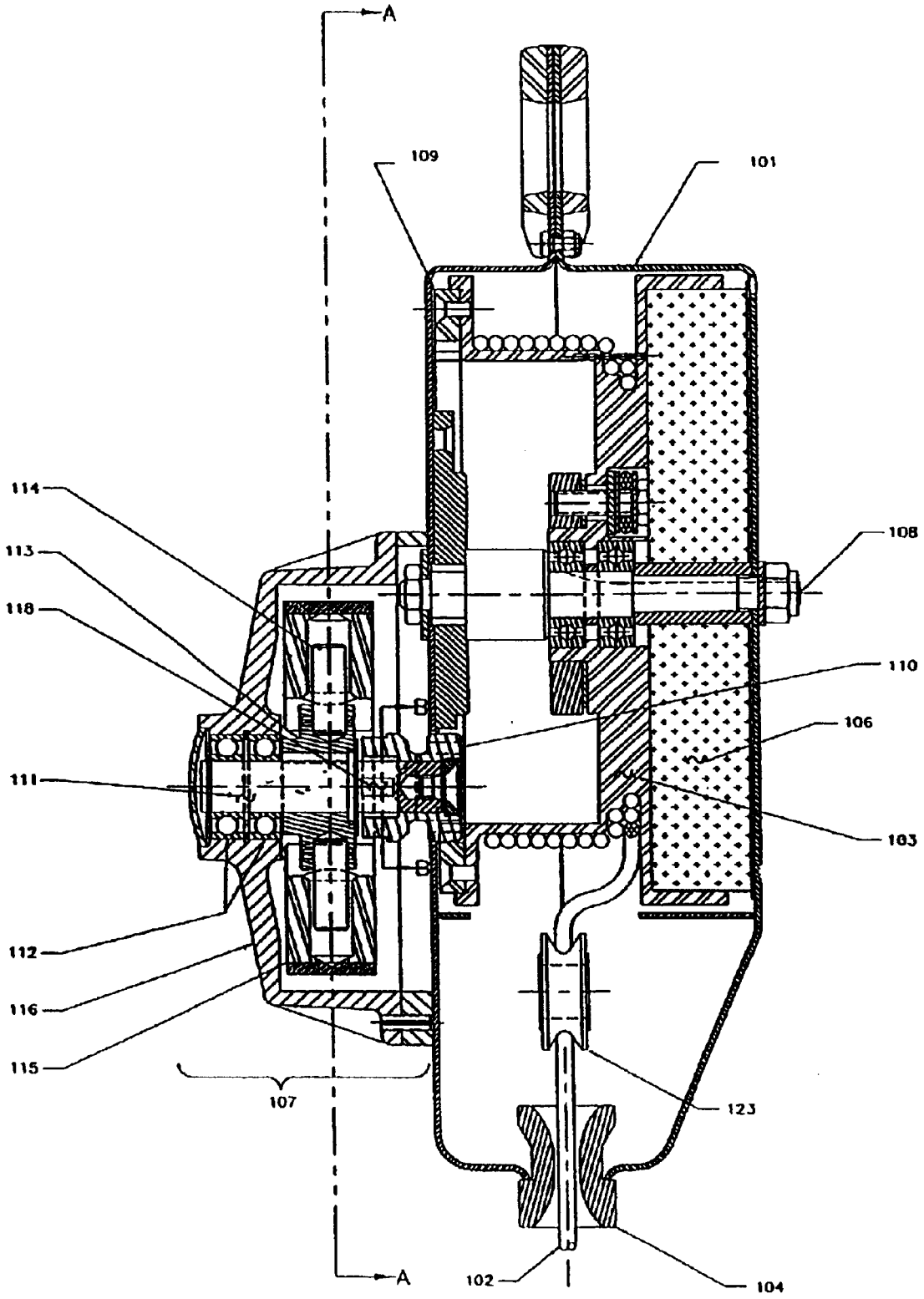
FIG. 2 PRIOR ART
FIG. 2 is cross-sectional view through line C—C of FIG. 1.
Figure 3:
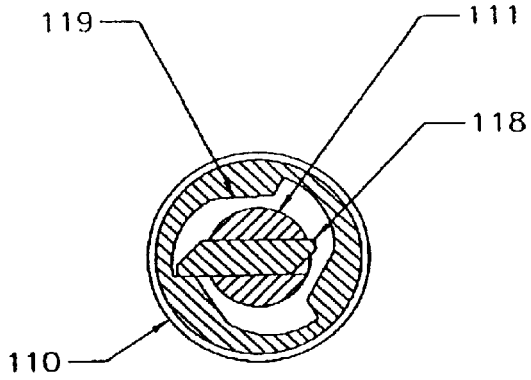
FIG. 3 PRIOR ART
FIG. 3 is a partial cross-sectional view through line B—B of FIG. 2.

The controlled descent device 10 of the present invention shown in FIGS. 4–10 comprises a steel housing 1 containing a line 23 having a carabiner 5 or the like on one end wound on a drum 24. A constant force retraction spring 6 provides a force on the drum 24 to retract the line 23 into the housing 1. A centrifugal brake mechanism 7 like the braking mechanism of the Dynescape® descender is attached to the housing and engages the drum to produce a resisting force when the line is extracted. The preferred embodiment of the braking mechanism 7 includes a brake hub 13, three spokes 14, brake shoes 15 and brake housing 16 similar in form and function to the Dynescape® descender. A pinion gear with shaft 29 is supported on the brake housing 16 by two roller bearings 12. The brake hub 13 is supported on the shaft by a one-way roller bear 21 and an additional bearing 12*a*.

This one-way bearing 21 may be one of several types of manufactured mechanisms such as those commercially available from Morse and Formsprag®, that produce a rotational motion in one direction and a fixed motion in the opposite direction such as back stopping, clutch or indexing bearings, roller-ramp type bearings or sprag clutches and sprag clutch/roller bearing combinations. Specifically, the one-way bearing permits rotation of its inner raceway relative to its outer raceway in one direction. When rotated in the opposite direction, the two raceways remain fixed with respect to one another, rotating in unison.

Figure 6:
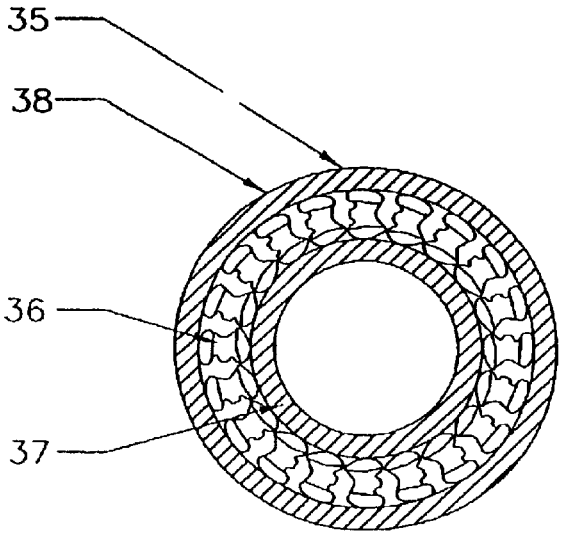
FIG. 6 is a cross-sectional view through line D—D of FIG. 5 showing a sprag type one-way bearing.
Figure 5:
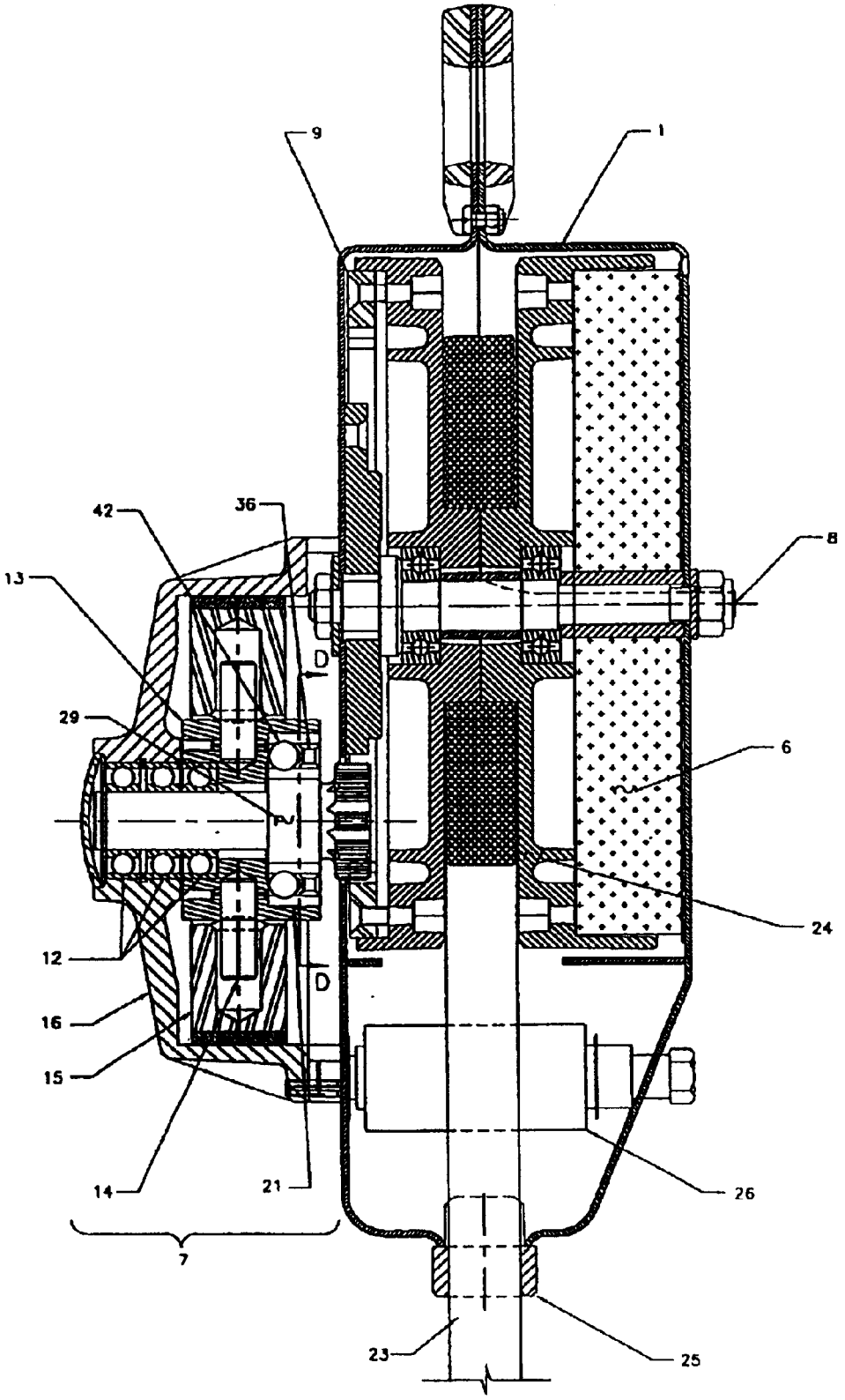
FIG. 5 is a cross-sectional view through line C—C of FIG. 4.

The sprag type bearing 35 illustrated in FIG. 6 contains a series of spring loaded sprags 36 that reside between, and are in contact with the inner 37 and outer 38 bearing raceways. When rotation of the outer raceway 38, relative to the inner raceway 37, is in one direction, these sprags 36 cam, locking the inner raceway 37 to the outer raceway 38. When rotation is in the opposite direction, the sprags 36 uncam, permitting the inner raceway 37 to rotate relative to the outer raceway 38. Sprag type bearings 35 frequently have a set of rollers 42 situated next to the sprags as shown in FIG. 5. These rollers provide concentricity and produce smooth rolling motion between the raceways.

Figure 7:
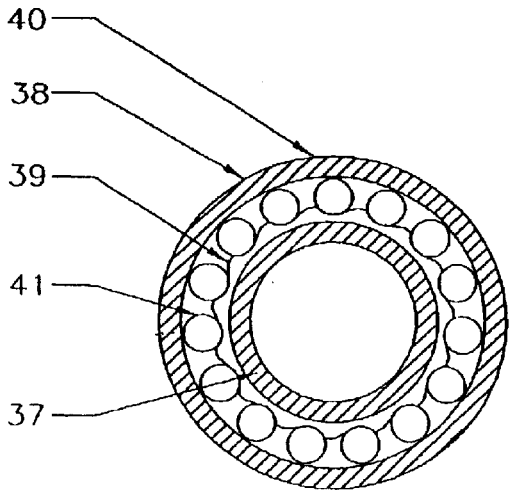
FIG. 7 is a cross-sectional view through line D—D of FIG. 5 showing a roller ramp type one-way bearing.
Figure 4:
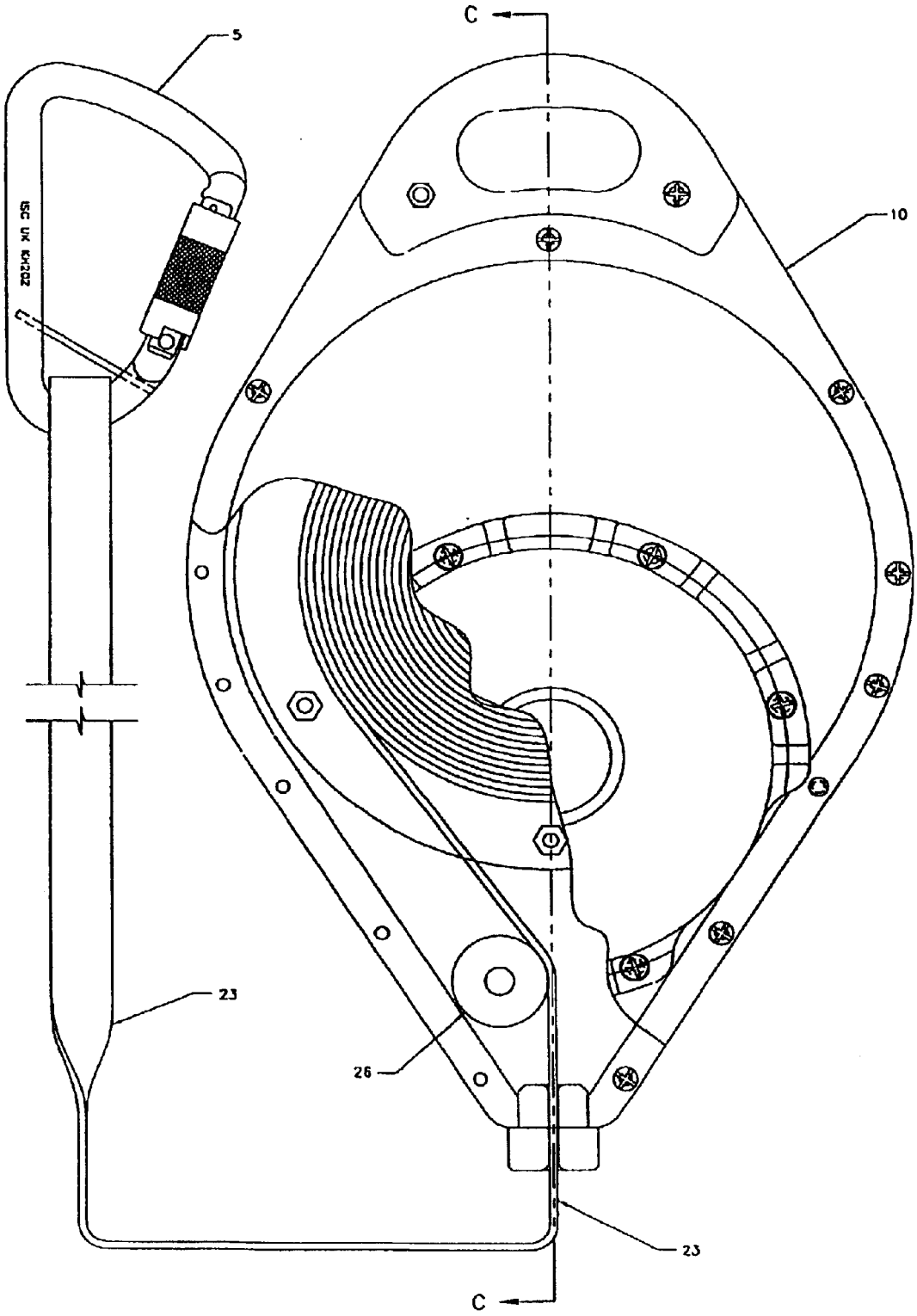
FIG. 4 is a front view shown partially in section of the present invention.

The roller-ramp type bearing 40 illustrated in FIG. 7 contains an array of balls or rollers 41 that reside between, and are in contact with the inner 37 and outer 38 raceways. The surface of the inner raceway 37 is ramped 39, such that the balls or rollers 41 roll up the ramps 39 during rotation in one direction, and down the ramps 39 in the opposite direction. As the balls or rollers 41 roll up the ramps, they wedge between the inner 37 and outer 38 raceway, preventing relative rotation of the inner 37 and outer 38 raceways. As the balls or rollers rolls down the ramps 39, they unwedge and provide clearance for the outer raceway 37 to roll relative to the inner raceway 37, like a standard roller bearing. The one-way roller bearing 21 connecting the shaft 29 to the hub 13 permits engagement of the brake mechanism only during line extraction. During line retraction, the pinion with shaft 29 will rotate freely, while the hub 13, spokes 14 and brake shoes 15 remain stationary.

The line 23 of the present invention is formed from flat webbing, preferably of nylon material. The drum 24 on which the line 23 is wrapped has side walls spaced slightly wider than the webbing width, such that when line 23 is wrapped on the drum 24 the line 23 will stack in consecutive layers. The line 23 passes through a nozzle 25 as it leaves the housing 1. The nozzle opening is dimensioned slightly larger than the webbing cross-section. This shape is designed to direct the webbing onto the drum 24 in consecutive layers. The webbing also passes across a cylindrical roller 26 between the nozzle 25 and drum 24. The roller 26 helps redirect the webbing 23 and lay it flat on the drum 24.

Figure 8:
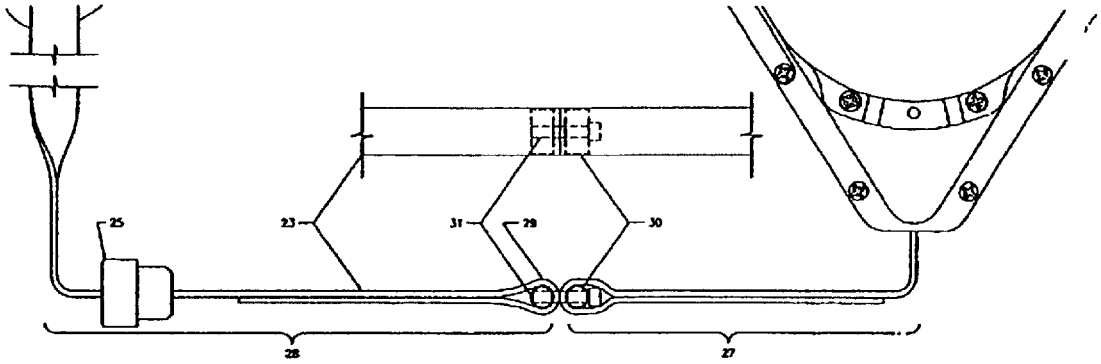
FIG. 8 is a front view of the present invention showing the preferred embodiment of the field replaceable feature.
Figure 9:
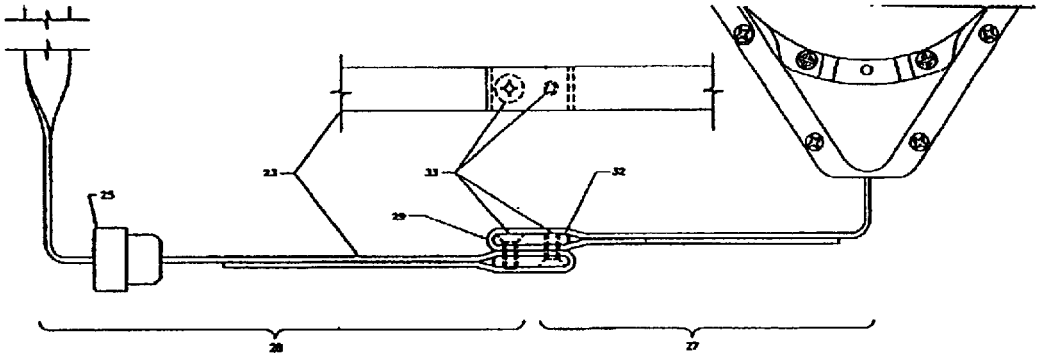
FIG. 9 is a front view of the present invention showing a second embodiment of the field replaceable feature.
Figure 10:
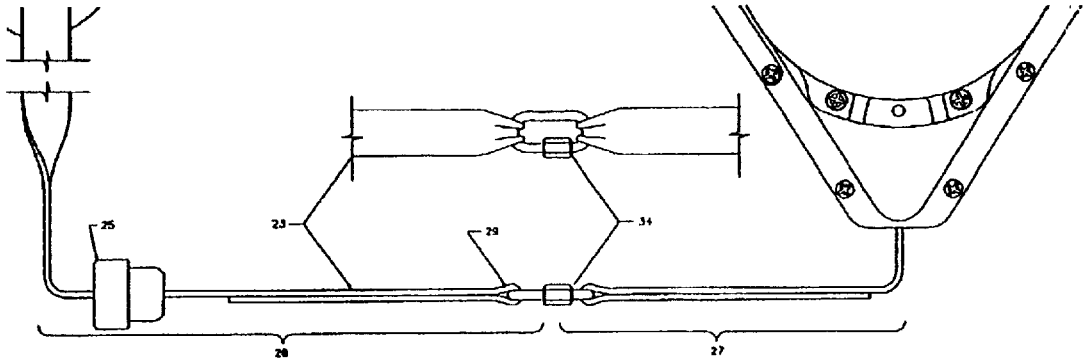
FIG. 10 is a front view of the present invention showing a third embodiment of the field replaceable feature.

The line 23 of the present invention may also be field replaceable as shown in FIGS. 8–10. The field replaceable line comprises an internal portion of line 27 that is permanently attached to the drum, and a distal portion of line 28 that extracts from the housing and is replaceable. The ends of each portion are joined by a linkage. The ends of the webbing are sewn in loops 29. In the preferred embodiment shown in FIG. 8, the loops 29 each contain a steel cylinder 30, oriented with their diameters supporting the webbing. A bolt 31 passes through a hole formed in the top of each loop 29 and through each cylinder. The linkage, including the two cylinders 30, has a width identical to the width of the webbing. The shape of the linkage facilitates it fitting inside the drum, and laying flat and neatly on the drum beneath the other layers of webbing. To replace the line, a user removes the nozzle 25, and extracts all of the line from the housing until the linkage is external to the housing. The user then disconnects the replaceable portion of line by removing the bolt 31 connecting the cylinders. A new nozzle 25, line 23, cylinders 30 and bolt 31 is then connected, replacing the worn components. The line 23 is then returned to the housing and the new nozzle 25 is re-attached.

It is contemplated that any means of joining two portions of webbing that are attached using loops that contain hardware joined by a screw, bolt or other means or two loops attached using a screw lock link could be substituted for the above-described arrangement. Alternate linkage mechanisms are illustrated in FIGS. 9 and 10. In a second alternate embodiment illustrated in FIG. 9, a steel plate 32 is threaded through each loop 29. At least one screw 33 and preferably two screws pass through the loops 29 and plates 33 to anchor the two portions of webbing together. FIG. 10 depicts a third alternate embodiment in which a screw lock link 34 is threaded through loops 29.

If not otherwise stated herein, it may be assumed that all components and/or processes described heretofore may, if appropriate, be considered to be interchangeable with similar components and/or processes disclosed elsewhere in the specification, unless an indication is made to the contrary.

It should be appreciated that the apparatus and methods of the present invention may be configured and conducted as appropriate for the application. The embodiments described above are to be considered in all respects only as illustrative and not restrictive. The scope of the invention is defined by the following claims rather than by the foregoing description. All changes which come within the meaning and range of equivalency of the claims are to be embraced within their scope.

What is claimed is:

1. A controlled descent device comprising:

a housing;

a rotatable drum supported within said housing;

a line constructed of flat webbing wound around said drum adapted for extraction and retraction from said housing;

a brake mechanism for engaging said drum to produce a resisting force during line extraction wherein said brake mechanism includes a pinion gear with a shaft supported on said housing, and a brake hub supported on said shaft by said one-way bearing; and a manufactured mechanism linking said brake mechanism to said drum for producing a rotational motion in one direction and fixed motion in the opposite direction.

2. The controlled descent device of claim 1 wherein said manufactured mechanism is a one-way bearing.

3. The controlled descent device of claim 2 wherein said one-way bearing is selected from the group consisting of roller, sprag clutches and sprag clutch with roller combinations.

4. The controlled descent device of claim 1 wherein said flat webbing is composed of a material having minimum 20% elongation at break.

5. The controlled descent device of claim 1 wherein said drum has side walls spaced slightly wider than the webbing width, whereby said line is adapted to be wound on said drum in consecutive layers.

6. The controlled descent device of claim 5 further including a nozzle supported by said housing through which said line is extracted, said nozzle including an opening slightly larger than the webbing width, whereby said line is directed onto said drum in consecutive layers.

7. The controlled descent device of claim 6 further including a cylindrically shaped roller supported by said housing for directing said line onto and off of said drum.

8. In a controlled descent device including a housing, a rotatable drum supported within said housing, a line wound around said drum adapted for extraction and retraction from said housing, a brake mechanism for engaging said drum to produce a resisting force during line extraction; wherein the improvement comprises a manufactured mechanism linking said brake mechanism to said drum for producing a rotational motion in one direction and fixed motion in the opposite direction and wherein said line further comprising a flat webbing having an internal permanent portion and a distal replaceable portion, said permanent portion and said replaceable portion having ends joined by a linkage, whereby said replaceable portion is adapted to be replaced when worn.

9. The controlled descent device of claim 8 wherein each of said joined ends has a loop wherein said linkage comprises a cylinder supported within each loop, and a bolt passing through holes formed in each loop and through each cylinder.

10. The controlled descent device of claim 8 wherein each of said joined ends has a loop, wherein said linkage comprises a screw lock link passing through the loops.

11. The controlled descent device of claim 8 wherein each of said joined ends has a loop, wherein said linkage comprises a plate supported within each said loop, and at least one screw passing through the loops and plates.

12. The controlled descent device of claim 8 wherein said one-way bearing is selected from the group consisting of roller, sprag clutches and sprag clutch with roller combinations.

13. A controlled descent device comprising:

a housing;

a rotatable drum supported within said housing;

a line constructed of flat webbing wound around said drum adapted for extraction and retraction from said housing; and wherein said line further comprises an internal permanent portion and a distal replaceable portion, said permanent portion and said replaceable portion having ends joined by a linkage, whereby said replaceable portion is adapted to be replaced when worn.

14. The controlled descent device of claim 13 wherein each of said joined ends has a loop wherein said linkage comprises a cylinder supported within each loop, and a bolt passing through holes formed in each loop and through each cylinder.

15. The controlled descent device of claim 13 wherein each of said joined ends has a loop, wherein said linkage comprises a screw lock link passing through the loops.

16. The controlled descent device of claim 13 wherein each of said joined ends has a loop, wherein said linkage comprises a plate supported within each said loop, and at least one screw passing through the loops and plates.

17. A controlled descent device comprising:

a housing;

a rotatable drum supported within said housing;

a line wound around said drum adapted for extraction and retraction from said housing;

a brake mechanism for engaging said drum to produce a resisting force during line extraction wherein said brake mechanism includes a pinion gear with a shaft supported on said housing, and a brake hub supported on said shaft by said one-way bearing; and a manufactured mechanism linking said brake mechanism to said drum for producing a rotational motion in one direction and fixed motion in the opposite direction, and wherein said manufactured mechanism is a one-way bearing.

18. The controlled descent device of claim 17 wherein said one-way bearing is selected from the group consisting of back-stopping, clutch, indexing roller, sprag clutches and sprag clutch with roller combinations.

19. A controlled descent device comprising:

a housing;

a rotatable drum supported within said housing;

a line wound around said drum adapted for extraction and retraction from said housing;

wherein said line further comprises an internal permanent portion and a distal replaceable portion, said permanent portion and said replaceable portion having ends joined by a linkage, whereby said replaceable portion is adapted to be replaced when worn;

wherein each of said joined ends has a loop; and wherein said linkage comprises one of the following:

a cylinder supported within each loop and a bolt passing through holes formed in each loop and through each cylinder;

a screw lock link passing through the loops; and a plate supported within each said loop, and at least one screw passing through the loops and plates.

* * * * *